US011031742B2

(12) United States Patent
Schmitz et al.

(10) Patent No.: US 11,031,742 B2
(45) Date of Patent: Jun. 8, 2021

(54) CONTACT AND BUSBAR ASSEMBLY FORMING A BUS SYSTEM ON ELECTRONICS HOUSINGS

(71) Applicant: Weidmüller Interface GmbH & Co. KG, Detmold (DE)

(72) Inventors: Till Schmitz, Detmold (DE); René Arntzen, Osnabrück (DE); Jörg Richts, Schlangen (DE)

(73) Assignee: Weidmüller Interface GmbH & Co. KG

( * ) Notice: Subject to any disclaimer, the term of this patent is extended or adjusted under 35 U.S.C. 154(b) by 0 days.

(21) Appl. No.: 16/277,212

(22) Filed: Feb. 15, 2019

(65) Prior Publication Data

US 2019/0260169 A1 Aug. 22, 2019

(30) Foreign Application Priority Data

Feb. 21, 2018 (DE) ..... 202018100964.8
Jan. 25, 2019 (DE) ..... 102019101878.1
Jan. 28, 2019 (DE) ..... 102019102011.5

(51) Int. Cl.
*H01R 25/14* (2006.01)
*H01R 25/16* (2006.01)
(Continued)

(52) U.S. Cl.
CPC ..... *H01R 25/145* (2013.01); *H01R 9/2675* (2013.01); *H01R 13/113* (2013.01);
(Continued)

(58) Field of Classification Search
CPC ..... H01R 13/113; H01R 12/7088; H01R 25/162; H01R 31/085; H01R 9/2458;
(Continued)

(56) References Cited

U.S. PATENT DOCUMENTS 10,050,394 B2 8/2018 Aporius et al.
2003/0040215 A1* 2/2003 Kleen ..... H01R 11/01 439/510
(Continued)

FOREIGN PATENT DOCUMENTS

CN 101369719 A 2/2009
CN 103151661 A 6/2013
(Continued)

*Primary Examiner* — Abdullah A Riyami
*Assistant Examiner* — Justin M Kratt
(74) *Attorney, Agent, or Firm* — Laubscher & Laubscher, P.C.

(57) ABSTRACT

A contact and busbar assembly forms a bus system on electronics housings arranged in an array. An electronics assembly such as a circuit board is arranged in each housing. The contact and busbar assembly includes multiple bus plugs each having first connecting contacts for contacting a respective circuit board, second terminal contacts in the form of one or more socket contacts and power rail strips. The power rail strips have at least one flexibly deformable section or are continuously flexibly deformable. Alternatively, the socket contacts are insertable not only parallel but also obliquely in relation to the power rail strips extending in the direction of the array for contact by the socket contacts.

14 Claims, 11 Drawing Sheets

(51) Int. Cl.

| | |
|---|---|
| ***H01R 9/26*** | (2006.01) |
| ***H01R 13/44*** | (2006.01) |
| ***H01R 13/453*** | (2006.01) |
| ***H01R 13/11*** | (2006.01) |
| *H01R 12/70* | (2011.01) |
| *H01R 4/30* | (2006.01) |
| *H01R 12/72* | (2011.01) |
| *H01R 9/24* | (2006.01) |
| *H01R 13/447* | (2006.01) |
| *H01R 13/24* | (2006.01) |
| *H01R 31/08* | (2006.01) |
| *H01R 13/502* | (2006.01) |
| *H01R 13/64* | (2006.01) |

(52) U.S. Cl.
CPC ..... *H01R 13/44* (2013.01); *H01R 13/4538* (2013.01); *H01R 25/162* (2013.01); *H01R 4/30* (2013.01); *H01R 9/24* (2013.01); *H01R 9/2458* (2013.01); *H01R 12/7082* (2013.01); *H01R 12/7088* (2013.01); *H01R 12/722* (2013.01); *H01R 13/2492* (2013.01); *H01R 13/447* (2013.01); *H01R 13/502* (2013.01); *H01R 13/64* (2013.01); *H01R 25/14* (2013.01); *H01R 25/142* (2013.01); *H01R 25/16* (2013.01); *H01R 31/085* (2013.01)

(58) Field of Classification Search
CPC . H01R 25/16; H01R 9/24; H01R 4/30; H01R 25/14; H01R 25/142; H01R 9/2675; H01R 13/64; H01R 13/4538; H01R 13/2492; H01R 12/722; H01R 25/145; H01R 13/44; H01R 13/447; H01R 12/7082; H01R 13/502
USPC ..... 439/813, 212, 510, 122, 251, 839, 845, 439/856, 857, 861
See application file for complete search history.

(56) References Cited

U.S. PATENT DOCUMENTS

| | | | | |
|---|---|---|---|---|
| 2009/0047814 | A1* | 2/2009 | Daamen ..... | H01R 13/18 439/251 |
| 2012/0264317 | A1 | 10/2012 | Blacerak | |
| 2014/0073204 | A1 | 3/2014 | Ramey et al. | |

FOREIGN PATENT DOCUMENTS

| | | | |
|---|---|---|---|
| DE | 2731850 | A1 | 1/1979 |
| DE | 202013103444 | U1 | 11/2014 |
| DE | 102017116342 | A1 | 2/2018 |
| EP | 1300619 | A1 | 4/2003 |
| JP | 63-128625 | U | 8/1988 |
| JP | 7-336848 | A | 12/1995 |
| JP | 2000100493 | A | 4/2000 |
| JP | 201584310 | A | 4/2015 |
| JP | 5741666 | B2 | 5/2015 |

* cited by examiner

CONTACT AND BUSBAR ASSEMBLY FORMING A BUS SYSTEM ON ELECTRONICS HOUSINGS

This application claims priority to German patent application No. 2018100964.8 filed Feb. 21, 2018, German patent application No. 102019101878.1 filed Jan. 25, 2019, and German patent application No. 102019102011.5 filed Jan. 28, 2019. The entire contents of these applications are incorporated herein by reference.

BACKGROUND OF THE INVENTION

The present invention relates to a combined contact and busbar assembly and to electronics housings assemblies having such a contact and busbar assembly.

BRIEF DESCRIPTION OF THE PRIOR ART

Generic contact and busbar assemblies are known per se from the prior art in greatly varying configurations, but generally have a relatively complicated structure which makes them relative expensive to manufacture.

DE 10 2017 116 342 A1 and DE 20 2013 103 444 U1 and also US 2012/0264317 A1 disclose various contact and busbar assemblies according to the prior art.

SUMMARY OF THE INVENTION

Against this background, it is the object of the invention to provide a contact and busbar assembly which is relatively simply constructed from a design aspect and is thus cost-effective, but is nonetheless functionally reliable.

The contact and busbar assembly is used to create a bus system on electronics housings which are arranged adjacent to one another in an array. An electronics assembly such as a circuit board is inserted in each housing. Each contact and busbar assembly includes multiple bus plugs each having one or more first connecting contacts for contacting a respective circuit board and one or more second connecting contacts in the form of socket contacts. One or more power rail strips having at least one flexible and deformable section is also provided.

Due to the flexible design of the power rail strips, tolerances in the structure resulting, for example, from the arrangement of the electronics housing on a mounting base and also resulting from the tolerances of the components used can be compensated for in a simple manner. The entire power rail strip is preferably flexible or formed as a continuous flexible section.

According to an alternate embodiment of the invention, the socket contacts are configured in such a way that they are insertable into power rail strips not only extending in parallel but also obliquely in relation to the array direction, so that they can be contacted by the socket contacts. According to this embodiment, it is not the respective power rail strip but rather the respective socket contact which is obliquely contacted. For this purpose, the assembly has contacts which are deflectable in such a way to contact a power rail aligned obliquely relative to the array direction. The socket contact can also be flexible or have two sections articulated in relation to one another in the array direction with a flexible conductive strip therebetween. These sections can incline somewhat in accordance with the power rail alignment. This provides a cost-effective busbar arrangement which is capable of relaying energy and/or data At least one of the socket contacts has spring legs which are spaced apart from and oppose one another to define a slotted contact zone which is aligned parallel in relation to the array direction X. Moreover, it can furthermore be provided that the opposing spring legs are divided into multiple contact portions in the array direction X, which are each separated from one another by gaps or notches in the array direction X, so that a quasi-flexible deformable socket contact is formed. Such a socket contact is suitable securing electrically conductive contacts of power rail strips aligned obliquely (for example, at an angle greater than 0° and less than 20°) in relation to the array direction X.

According to another embodiment, the contact portions are formed rounded and/or convex in sections on the sides facing one another to provide an even more secure electrically conductive contact of power rail strips aligned obliquely in relation to the array direction X.

A projection is provided on one or more of the socket contacts which engages in a corresponding opening of the respective circuit board to be contacted to provide a twist lock between the socket contacts and the circuit board.

An electronics housing assembly made of a plurality of electronics housings which can be arrayed on or adjacent to one another in the array direction X can be formed as rack housings with a fully or partially open connecting side. At least one contact and busbar assembly is provided on the connecting side of the housing assembly for connection with a circuit board while accommodating an offset of the circuit board in a direction perpendicular to the array direction because of tolerances.

According to a further embodiment of the invention, a contact and busbar assembly is provided for forming a bus system on electronics housings arrayed in an array direction. An electronics assembly such as a circuit board is inserted into each contact and busbar assembly. Each contact and busbar assembly has one or more bus plugs each having one or more first connecting contacts contacting a respective circuit board and one or more second connecting contacts which are formed as socket contacts. Power rail strips contact the second connecting contacts. The socket contacts are designed in such a way that the first connecting contacts are formed on the side of the contact and busbar assembly facing away from the socket or second connecting contacts. A further contact zone between the first and second connecting contacts can be omitted, which results in a simpler structure. The socket contacts are formed in one piece for this purpose.

The first connecting contacts are formed as a respective screw terminal on the socket contact. Alternatively, the first connecting contact is formed as a solder terminal, which enables direct contact of the circuit board or a respective conductive region of the circuit board with the first contact.

BRIEF DESCRIPTION OF THE FIGURES

The invention will be described in greater detail below with reference to the accompanying drawings in which.

DETAILED DESCRIPTION

Figure 1:
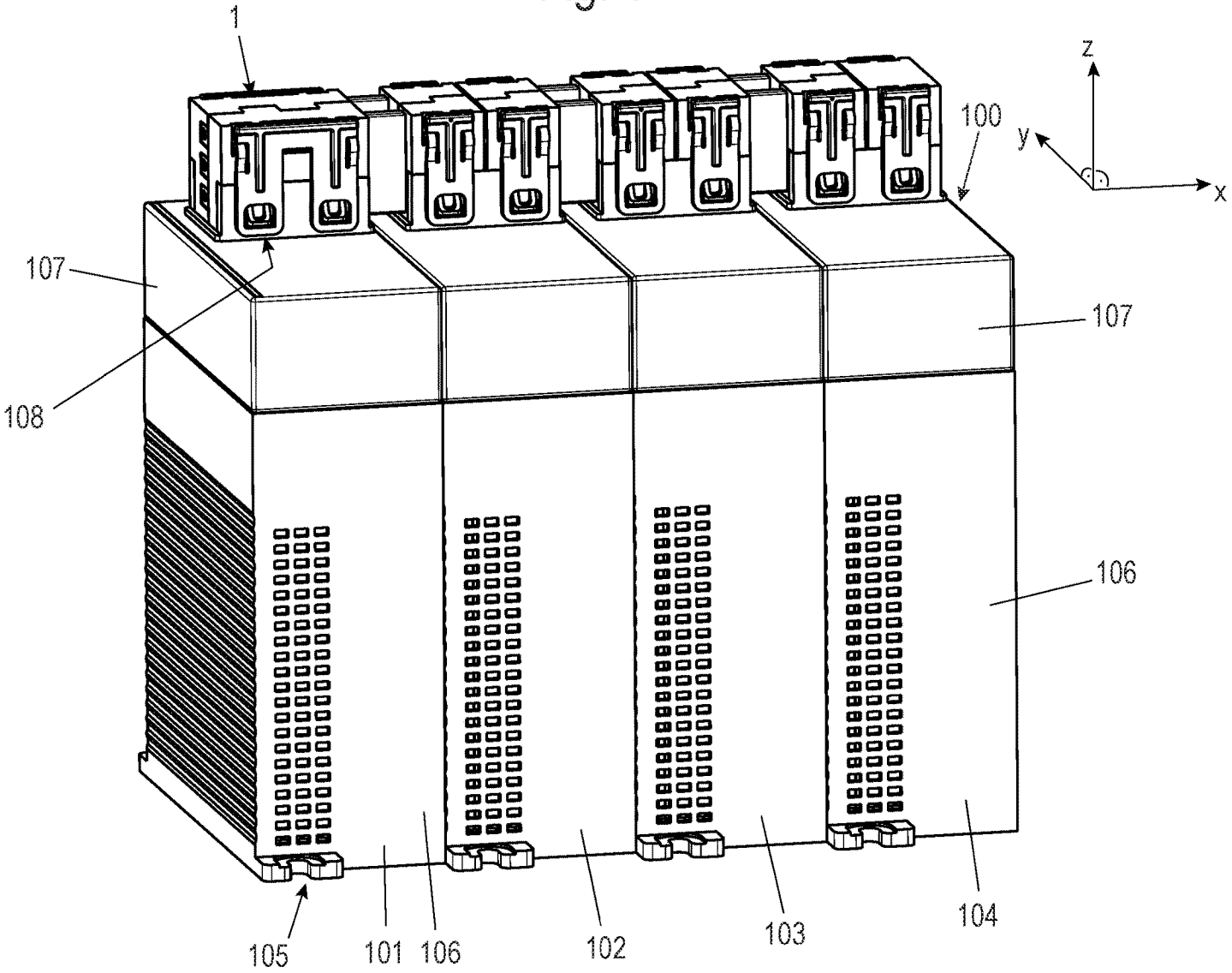
FIG. 1 is a perspective view of an electronics housing assembly having a contact and busbar assembly according to the invention.

FIG. 1 shows an electronics housing assembly 100. The electronics housing assembly 100 has a plurality of electronics housings 101, 102, 103, 104 which can be arranged directly adjacent to one another or arranged at least indirectly adjacent to one another in an array direction X. Four of the electronics housings 101, 102, 103, 104 arrayed adjacent to one another are shown, although any number may be provided.

The electronics housings 101, 102, 103, 104 can be designed as rack housings, surfacemounted housings, or screw-on housings as shown in FIG. 1 which are fastenable via fasteners 105 on a base (not shown) using screws for examples.

Figure 2:
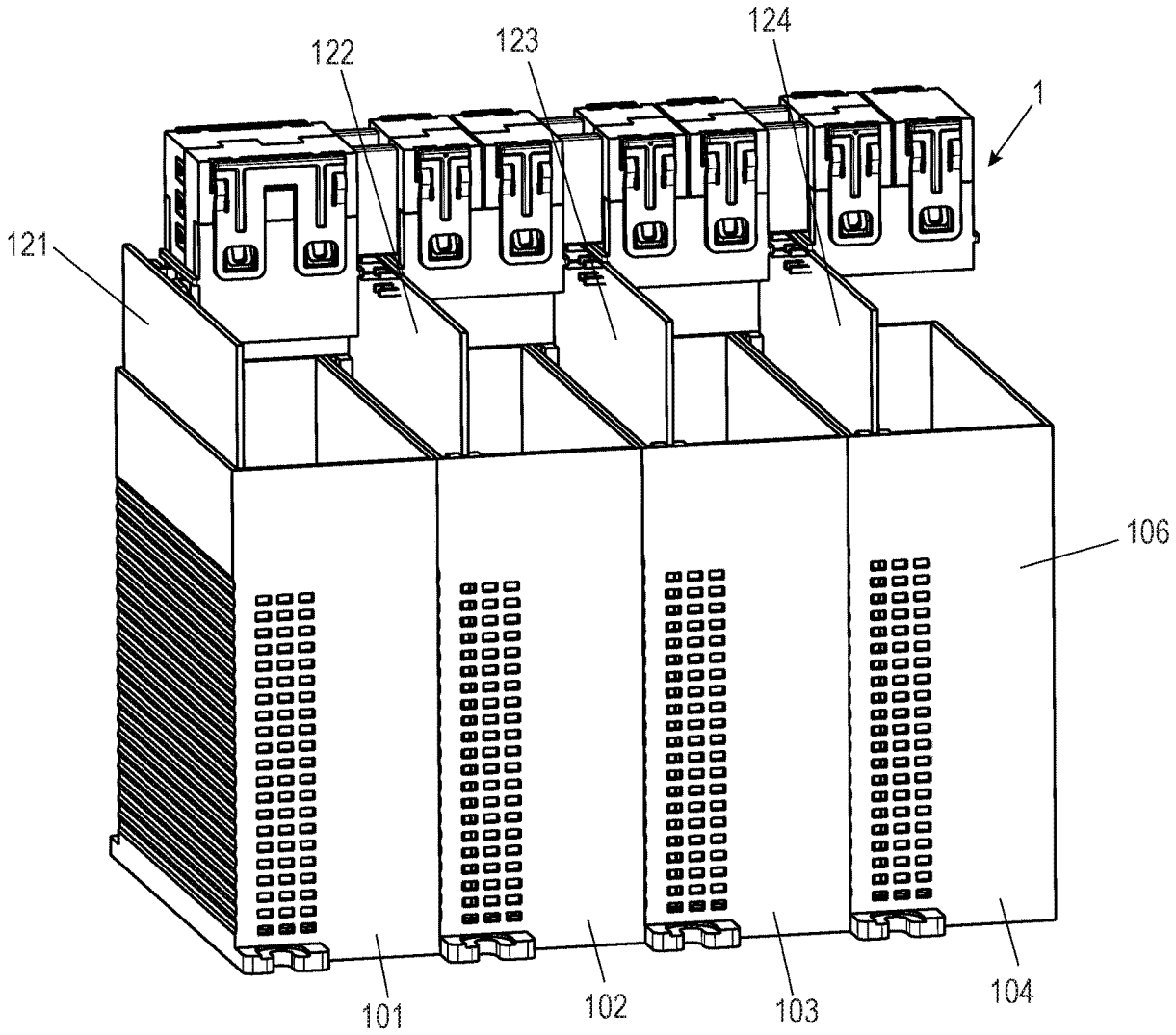
FIG. 2 is a perspective view of the assembly of FIG. 1 without a housing cover.

The electronics housings 101, 102, 103, 104 each have a main housing 106 and a cover 107 which covers an open narrow side of the main housing 106 as also shown in FIG. 2. In this case, the covers 107 have a window 108 or a peripheral opening.

At least one circuit board 121, 122, 123, 124 is inserted into each of the electronics housings. The circuit boards 121, 122, 123, 124 are aligned perpendicular to the array direction X and/or parallel to a Y-Z plane so that they are arranged essentially parallel to the electronics housings 1. The axes X, Y, and Z form the three axes of a Cartesian coordinate system.

A contact and busbar assembly 1 is formed on the circuit boards for forming a single or multiple bus system on the electronics housings. In this regard and with respect to the structure of the contact and busbar assembly, reference is also made in particular to FIGS. 3-6*b*.

Figure 3:
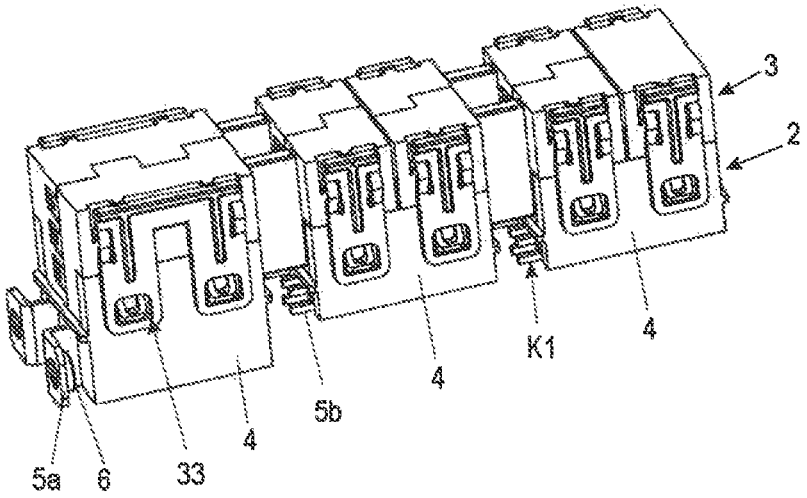
FIG. 3 is a perspective view of a section of the contact and busbar assembly of FIGS. 1 and 2.
Figure 4:
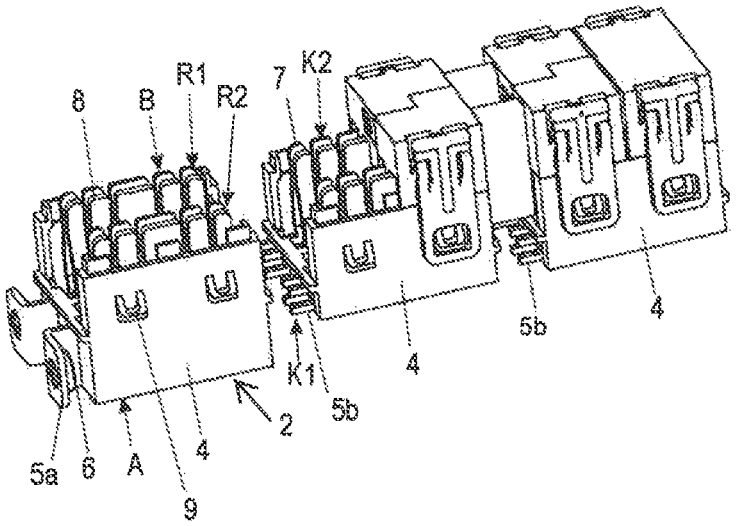
FIG. 4 is a perspective view similar to FIG. 3 wherein a portion of a busbar assembly has been removed.

The contact and busbar assembly 1 has a bus plug 2 on each of the electronics housings as shown in FIG. 3.

The contact and busbar assembly 1 has one or more power rail assemblies 3, which conductively connect the bus plugs 2 of adjacent electronics housings to one another.

At least one bus plug 2 is positioned on each circuit board. In the illustrated embodiment, one bus plug 2 is provided per electronics housing. This bus plug contacts the respective circuit board 121 to 124 in the respective electronics housing.

The bus plugs 2 can be formed as identical or substantially identical structures. A preferred structure of such a bus plug 2 will be described in greater detail hereafter. The structure can thus be transferred to all of the four bus plugs 1 in the illustrated embodiment except for the differing design of the contacts K1. However, all contacts K1 can also be designed to be identical such as, for example, as screw terminals or solder terminals.

As shown in FIGS. 3-6, each bus plug 2 includes a housing 4 having a first connecting side A having first connecting contacts K1 and a second connecting side B having second connecting contacts K2. In comparison to a bus plug disclosed in US patent application publication No. 2012/0264317 A1, an intermediate adapter plug and thus a further contact zone between the respective circuit board and the bus plug is omitted.

The first connecting contacts K1 on the first connecting side A are formed on a first of the bus plugs as a screw terminal 5*a* having a screw 6*a* and nut 6. The screw terminal 5*a* is formed as a tab having a passage opening and contacts the circuit board. A screw passes through the passage opening. In this way, energy or current is to be fed via this screw terminal 5*a* from the circuit board 121 of the first electronics housing 101 directly via the bus plug 1 into the contact and busbar arrangement 1 and into the arrayed circuit boards of the arrayed electronics housings 102, 103, 104.

Accordingly, the socket contacts are designed in such a way that the first connecting contacts K1 are also directly formed on the side thereof facing away from the actual socket contacts or on the side thereof facing away from the second connecting contacts K2.

The first connecting contacts K1 of the remaining bus plugs 1 on the first connecting side A are preferably in the form of solder pins 5*b*, which electrically conductively contact the respective circuit board. The solder pins 5*b* preferably extend parallel to or in the array direction X. The solder pins can be formed as ends of the socket contacts. These solder surfaces or the like then form the first connecting contacts K1.

The socket contacts are also accordingly designed in such a way that the first connecting contacts K1 are also directly formed on the side thereof facing away from the actual socket contacts or on the side thereof facing away from the second connecting contacts K2.

The contact zone, in which the first connecting contacts K1 contact the actual circuit board lies inside the electronics housing 1. The second connecting contacts K2 on the opposing side of the housing 4 of the bus plugs 1, which are in one piece here, are preferably formed as socket contacts 7 formed as single or multiple contacts, which protrude from the housing 4. In this case, these socket contacts 7 each have spring legs spaced apart from one another and opposing one another, between each of which a slotted contact zone 8 is formed. The respective slotted contact zone 8 is preferably aligned parallel to the array direction X.

The second connecting contacts K2 preferably protrude outwardly from the connecting side A of the housing beyond the electronics housing. The first and the second connecting contacts K1 and K2 or 5*a* or 5*b* and 7, respectively, can be conductively connected to one another, for example, via one or more busbar pieces or the like (not shown).

One of the bus plugs 2, each of which has a plurality of the first connecting contacts K and two of the second connecting contacts K2 or socket contacts 7, respectively, is provided for each electronics housing.

The number of elements and components described herein are to be considered only as advantageous examples. Other numbers of elements and components can also be provided. The contacts are preferably distributed in such a way that two potentials can be connected or distributed further for each bus plug 2.

The socket contacts 7 of the bus plugs 2 are arranged in two rows R1, R2 parallel to the array direction X, wherein the slotted contact zones 8 are each aligned parallel to the array direction X.

In this case, the first connecting contacts K1 are used for contacting the respective circuit board with a power and/or data bus and the second connecting contacts K2 are used for contacting a power rail assembly 3 for relaying a respective potential of a power and/or data bus from circuit board 121 to the circuit board and/or from one of the electronics housings arrayed adjacent to one another to another of the electronics housing. The power rail assembly 3 is therefore required to supply power in a simple and efficient manner.

Figure 5:
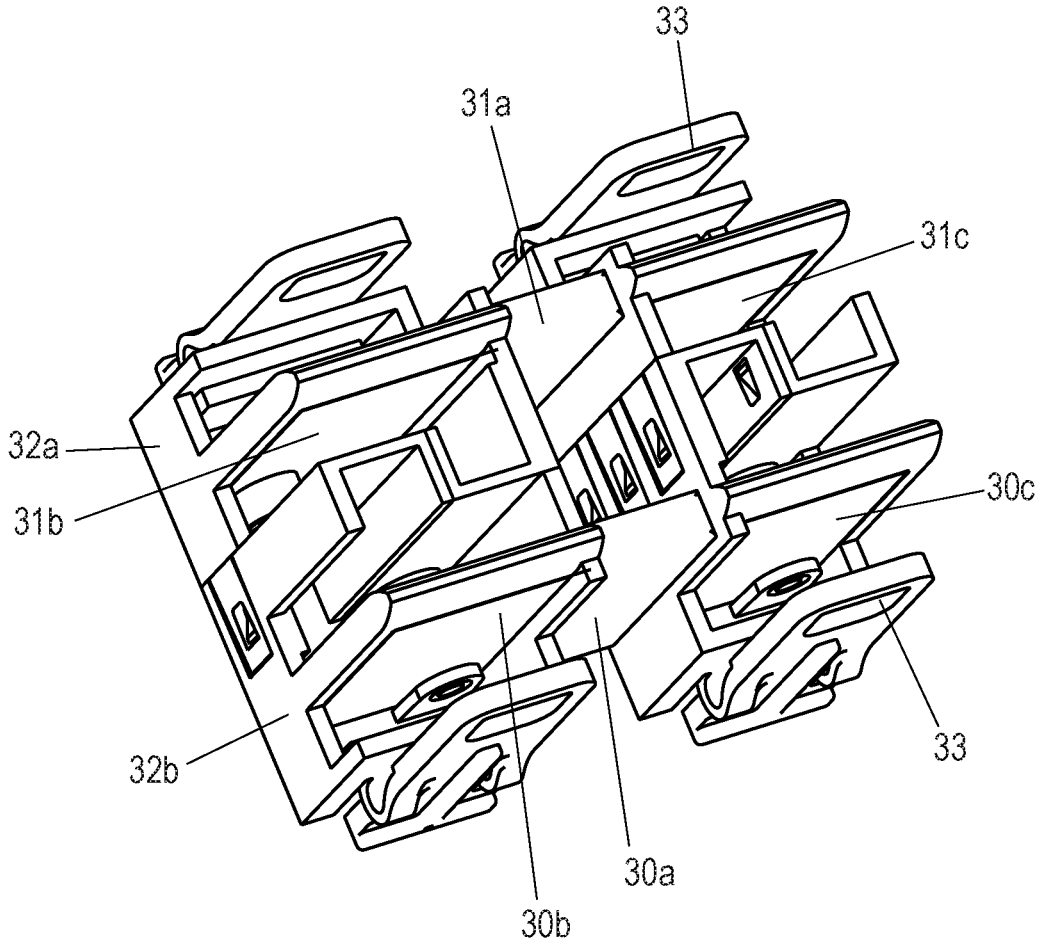
FIG. 5 is a top perspective view of a busbar assembly.

The preferred power rail assembly 3 can be formed from one or more power rail strips 30, 31 and shells or covers 32 as shown in FIGS. 5 and 6. However, the power rails can be formed continuously over all of the bus plugs or can connect individual ones of these bus plugs 2. The power rails are inserted into the bus plugs 2 or the socket contacts 7 thereof like contact blades in order to conductively connect two or more of the bus plugs 2.

The covers 32 are preferably provided with catch devices 33 for locking onto corresponding counter catch devices 9 of the housing 4 of the bus plugs 2.

The power rail strips 30, 31 are formed of material having good electrical conductivity and particularly a metal such as a copper alloy.

The power rail strips 30, 31 are reversibly flexibly deformable at least sectionally at least perpendicularly to the main extension direction of the power rail strips 30, 31.

The required flexible design can be achieved in that the respective power rail strips 30, 31 are formed in sections 30*a*, 31 *a* from a type of single-layer or multilayer braid of metal wires.

The flexible design can alternatively also be achieved by forming the power rail strips 30, 31, at least in a section 30*a*, 31 *a*, from multiple thin sheet metal strips layered in parallel like slats.

A copper alloy is preferably used as the metal for manufacturing the power rail strips 30*a*, 30*b*.

Nonflexible sections 30*b*, 30*c* or 31*b*, 31*c*, respectively, adjoin each of the flexible sections 30*a*, 31*a*.

In this way, a power rail strip 30 or 31 which is at least sectionally flexible perpendicular to the array direction in any case is formed.

The nonflexible sections 30*b*, 30*c* or 31*b*, 31*c* are preferably fixed inside a respective corresponding cover 32. The respective flexible sections 30*b*, 31*b* or 30*c*, 31*c* extend in each case between two adjacent bus plugs 2, and the covers 32 are each only provided in the region of the bus plugs 2.

The power rail strips are preferably fixed in the nonflexible sections 30*b*, 30*c* or 31*b*, 31*c* on the covers 32, for example, via pins 34 on the covers 32 that engage in the receptacle holes 35 of the sections 30*b*, 31*b*; 31*b*, 31*c* as shown in FIG. 6.

Figure 6A:
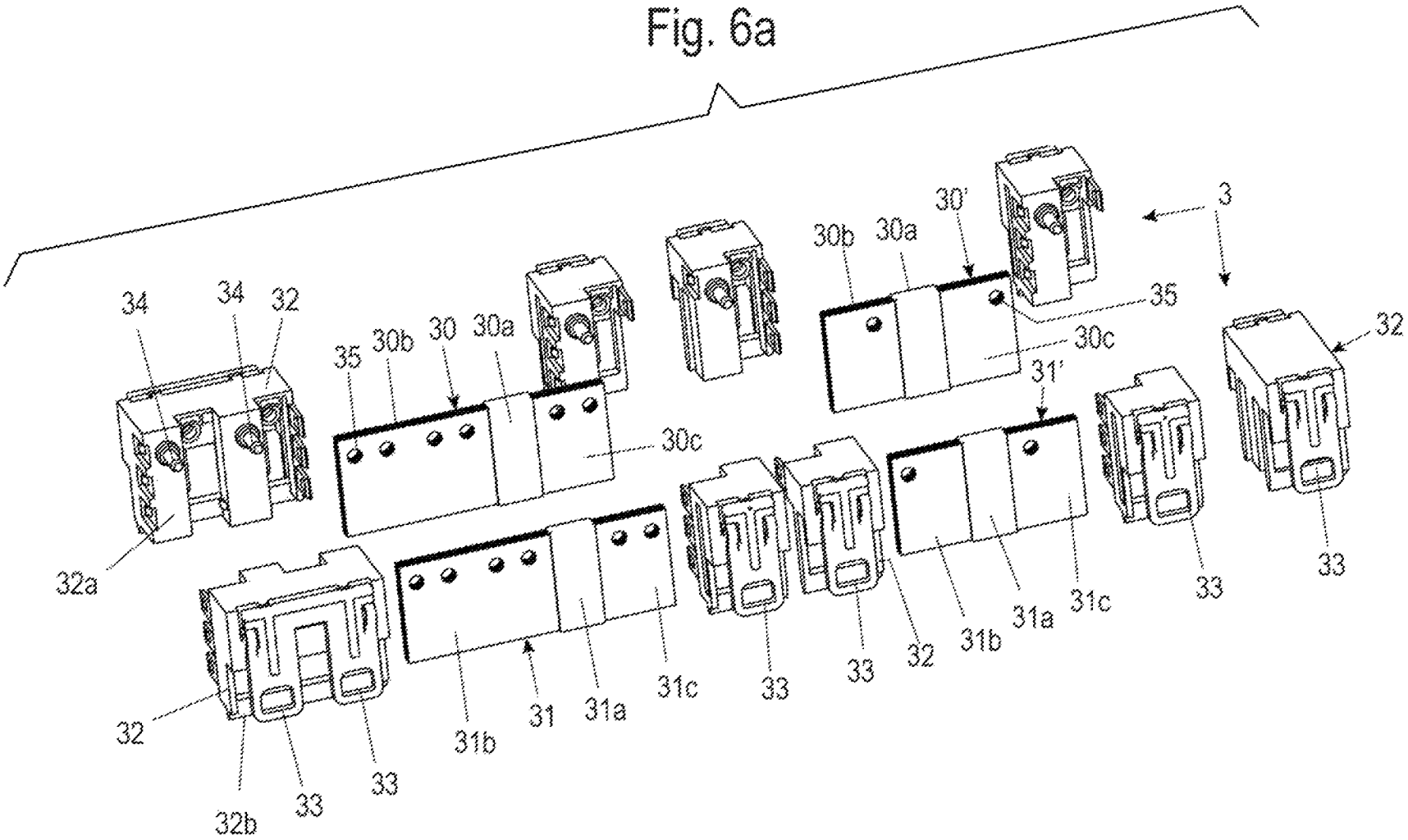
FIG. 6*a* is an exploded perspective view of a power rail strip assembly of the contact and busbar assembly of FIG. 3.
Figure 6B:
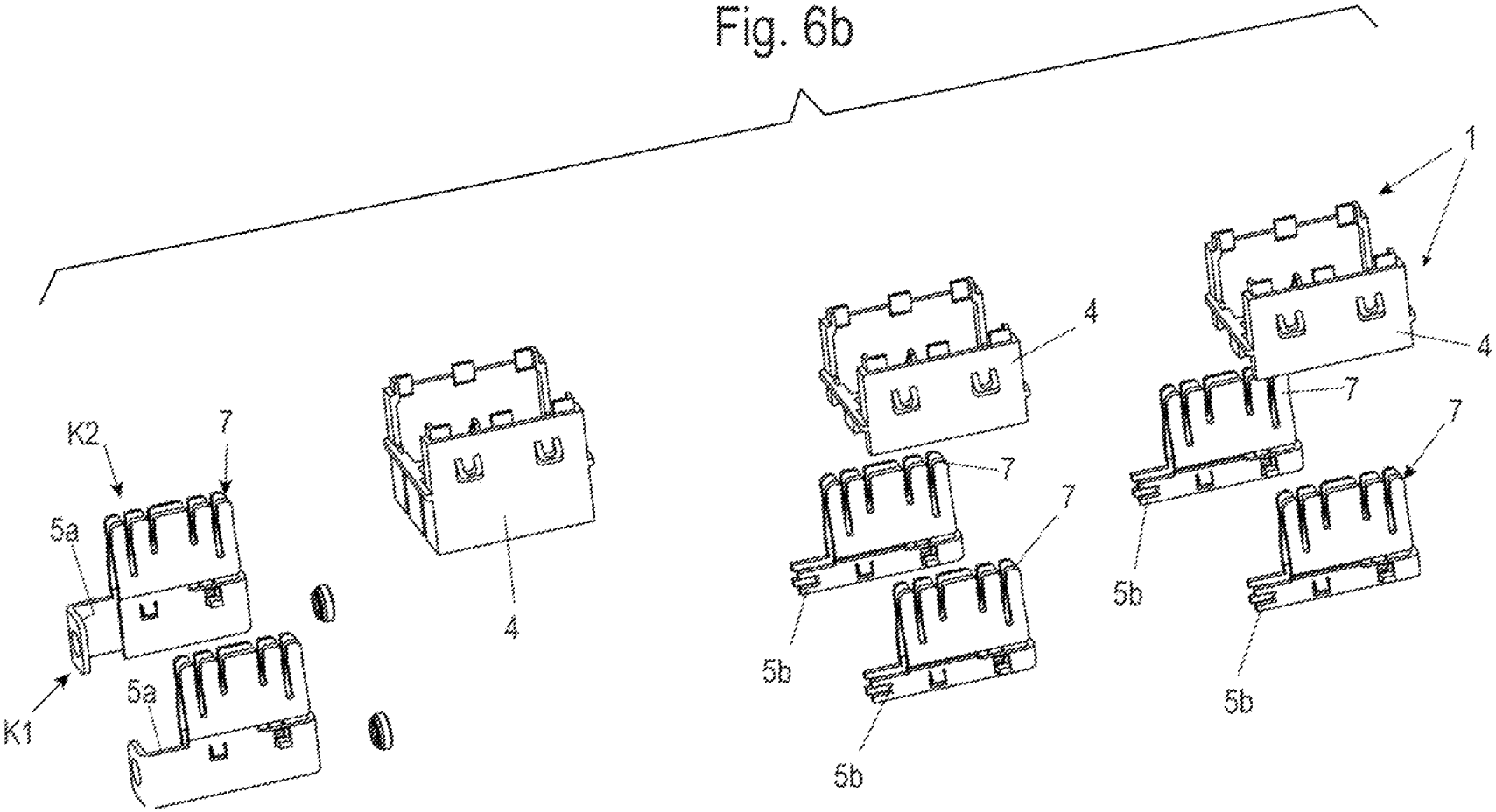
FIG. 6*b* is an exploded perspective view of the contact assembly and housing of the contact and busbar assembly of FIG. 4.

The power rail strips 30, 31 extend over a plurality of the covers 32 or bus plugs 2—preferably two—and thus connect at least two or more of the bus plugs 2 to one another as shown in FIGS. 5 and 6*a*. In the region of the socket contacts 7, the power rail strips can then be used for the power supply to the respective circuit board or also for the power to the closest busbar section 30 to 30', etc. It is then necessary and advantageous that the socket contacts 7 of adjacent electronics housings conductively connect each of the two power rail strips 30, 30' or 31, 31' adjacent in the array direction to one another as shown in FIG. 6*a*.

In the first electronics housing 101—which can also be referred to as a feed module—the two power rail strips 30, 31 can be continuously formed over the entire socket contacts 7 and can extend up to the adjacent electronics housing 102 having a bus plug 2 and can contact the two socket contacts 7 therein.

According to an alternate embodiment, however, the power rail strips 30, 31 can also be designed to be flexible over the entire length thereof.

It is particularly advantageous that due to the sectionally or continuously flexible design of the power rail strip or strips 30, 31 in a direction Y perpendicular to the array direction X, tolerances in the structure can be compensated for in a simple manner. These tolerances arise from the arrangement of the electronics housings on a mounting base and from tolerances of the components of the assembly. Preferably, tolerances can also be compensated for in the array direction X and/or in the Z direction if a wire braid is used for the flexible regions.

It is also possible to provide the power rail strips between the bus plugs 2 arrayed against one another with insulation which also has limited flexibility.

The housings and covers 32 of the bus plugs 2 can be formed in one or multiple pieces and in particular can be assembled from multiple housing/cover sections 32*a*, 32*b*. They can interlock via steps or the like. The housing/cover sections 32*a*, 32*b* can also be lockable on one another as shown in FIG. 6*a*.

The pins 34 can also be used to center the housing/cover halves 32*a*, 32*b* on openings or the like or to connect the halves.

Higher currents and/or a higher level of energy can also be easily transmitted using one or more of the power rail strips 30, 31.

Figure 7:
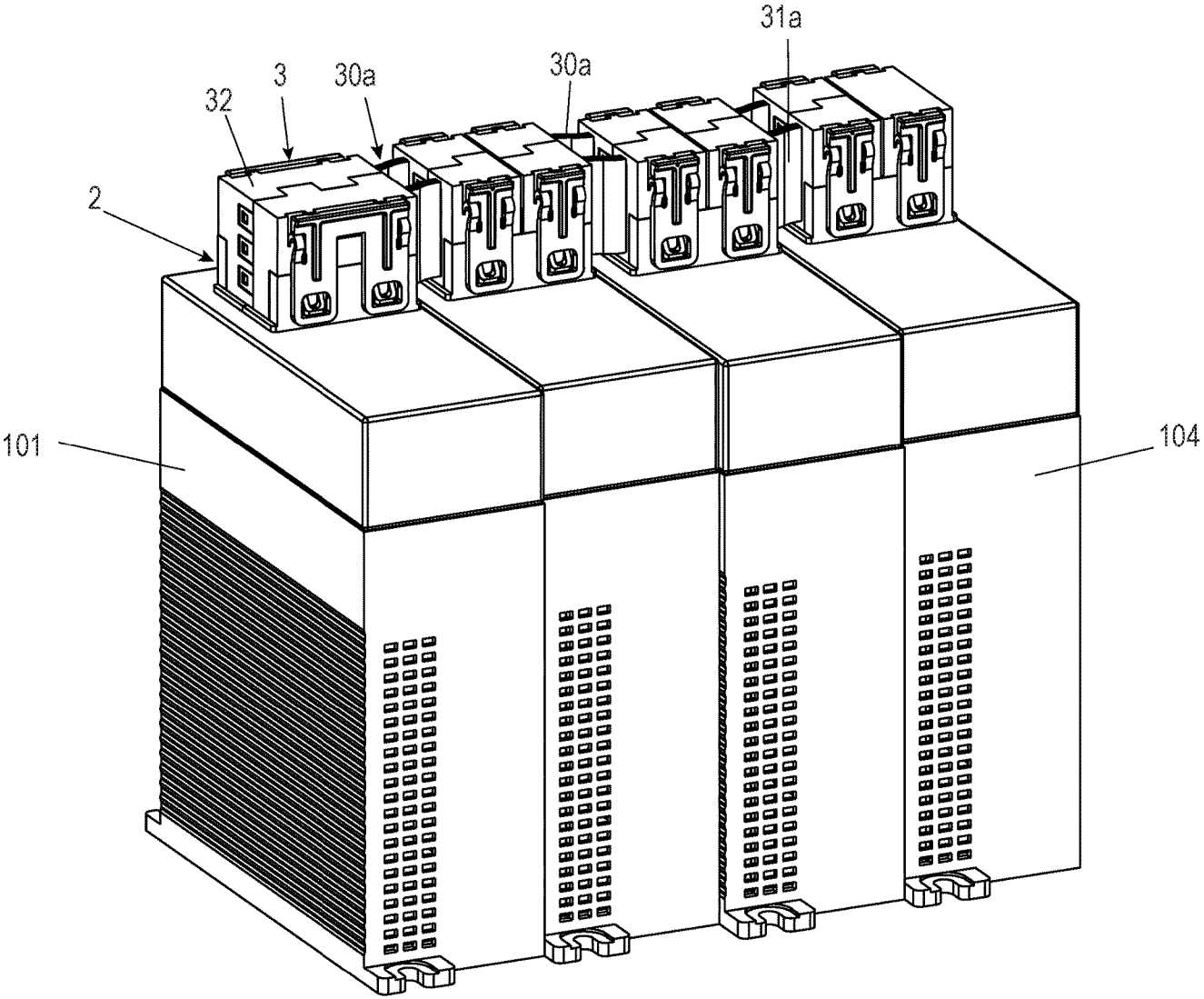
FIG. 7 is a perspective view of the electronics housing assembly of FIG. 1 with a contact and busbar assembly according to the invention.
Figure 8:
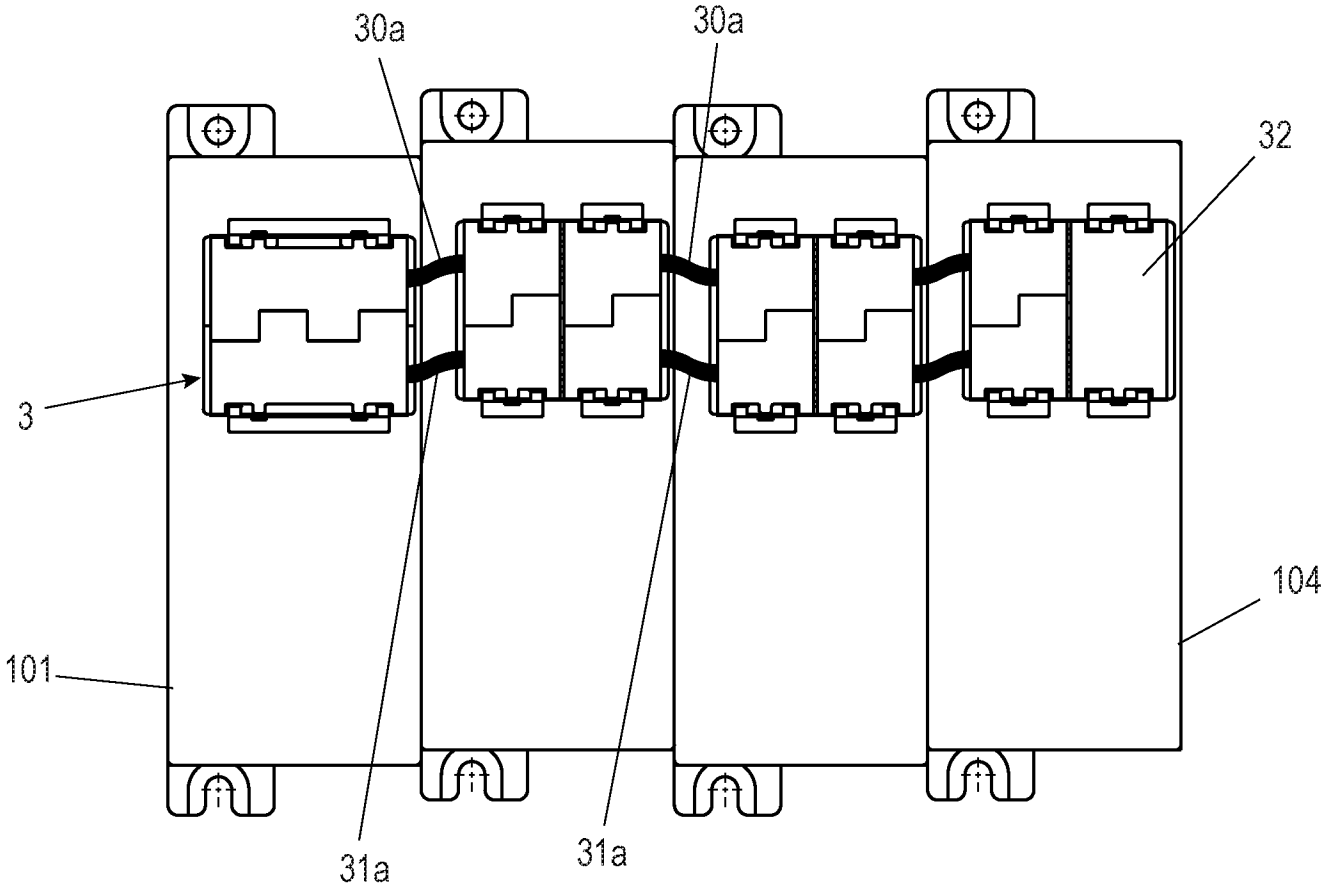
FIG. 8 is a top view of the electronics housing assembly of FIG. 7.

In this manner, it is possible to directly conductively connect the bus plugs 2 over two or more of the electronics housings. The covers 32 including the pre-mounted power rail strips 30, 31 are plugged onto the bus plugs and plugged therein for this purpose. Tolerance variations occurring in this case are compensated for by the flexible sections 30*a*, 31 *a* in the region between the covers 32 as shown in FIGS. 7 and 8.

Figure 9:
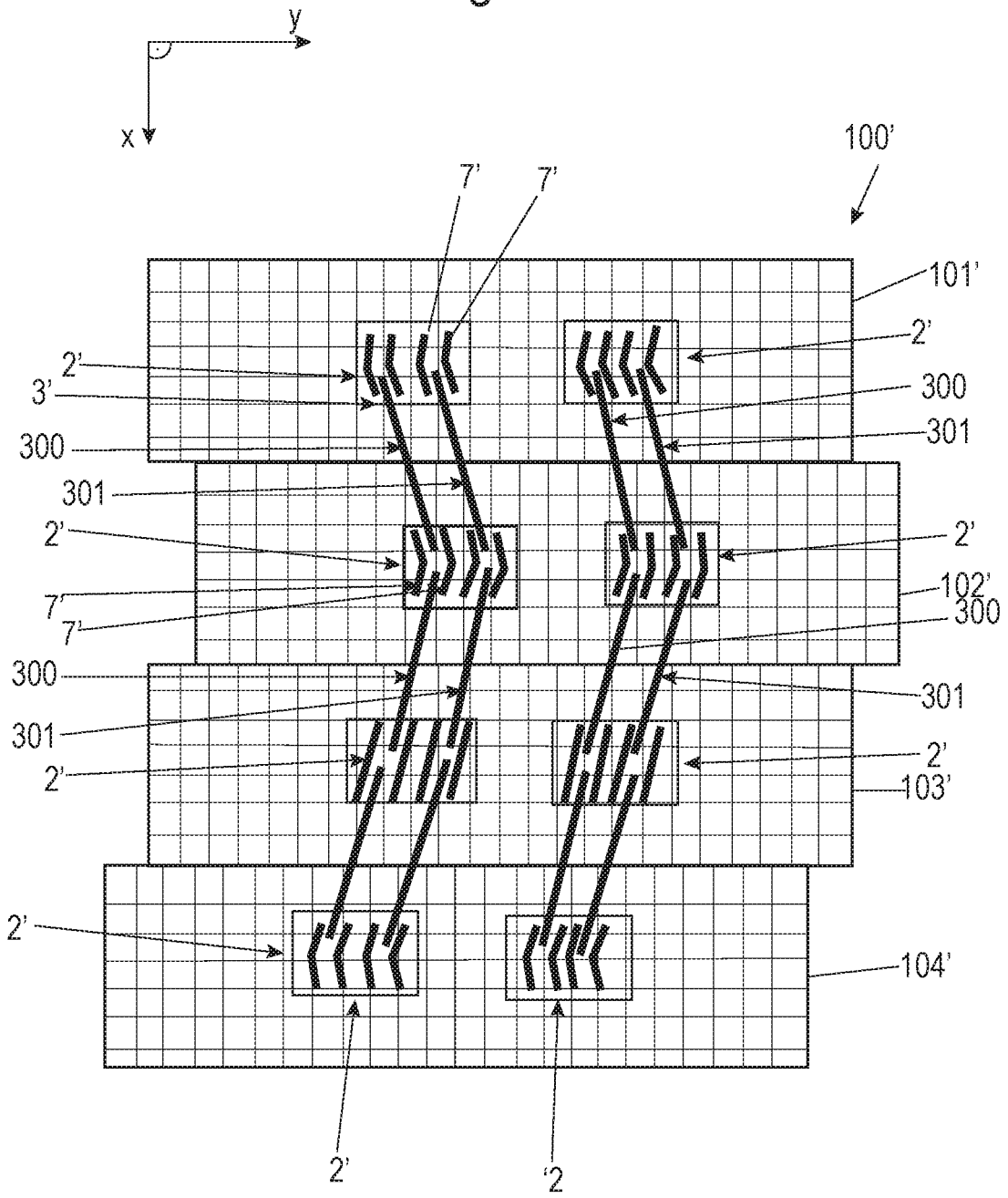
FIG. 9 is a top schematic view of electronics housing assembly according to the invention having a contact and busbar assembly according to an alternate embodiment.

FIG. 9 is a schematic illustration of a further embodiment of an electronics housing assembly 100'. This electronics housing 100' also has a plurality of electronics housings which can be arrayed directly against one another or are arrayed at least indirectly adjacent to one another in an array direction X. Four of the electronics housings 101', 102', 103', 104' arranged adjacent to one another are shown by way of example. They are arranged against one another in the array direction X. In the Y direction perpendicular to the array direction X, the electronics housings are slightly offset in relation to one another because of tolerances. This is also illustrated in FIG. 9.

The electronics housing assemblies 101' to 104' can be constructed like the electronics housing assembly of FIGS. 1 to 8. Reference is thus made to the above description of FIGS. 1 to 8, which also applies to FIGS. 9-11 except for the differences to be described below.

The contact and busbar assembly 1 again has one or more power rail assemblies 3', which conductively connect the bus plugs 2' of adjacent electronics housings to one another. In this embodiment of the contact and busbar assembly, the power rail strips 300, 301 are rigid. This means they do not have any especially flexibly designed sections. The power rail strips 300, 301 rather have metal rail strips cut to length from a material having good electrical conductivity, in particular a metal or a metal alloy. Sections of the strips are coated using plastic or other insulating materials and/or are provided with covers (not shown as in FIGS. 1 to 8).

To connect the bus plugs 2 to one another by the power rail strips 300, 301 in the array direction of adjacent electronics housings 101'-104', the tolerance compensation of the offset perpendicular to the array direction X is not performed via the power rail strips 300, 301', but rather via the bus plugs 2'. The socket contacts 7' of the bus plugs 2', in which each two adjoining power rail strips 300, 301 are pluggable in order to contact the socket contacts 7' are designed in such a way that power rail strips 30', 31' are also pluggable therein in a nonlinear direction and/or inclined to the array direction.

This is achieved in various ways. According to the embodiment illustrated in FIGS. 9, 10, and 11, the socket contacts 7' each have opposing spring legs spaced apart from one another, between which a slotted contact zone 8' is formed. The respective slotted contact zone 8' is preferably aligned parallel to the array direction X.

Figure 10A:
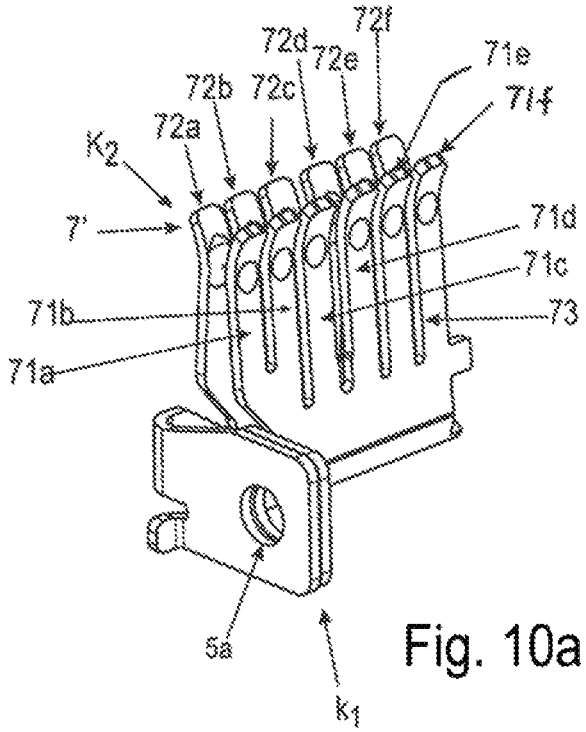
FIG. 10*a* is a perspective view of a bus plug according to the invention.
Figure 10C:
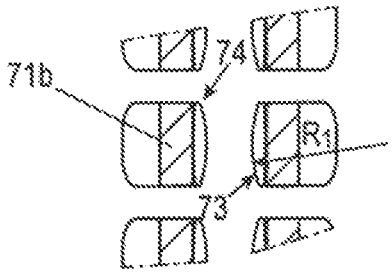
FIG. 10*c* is a partial sectional view of a portion of the bus plug taken along line A-A in FIG. 10*b;*
Figure 10B:
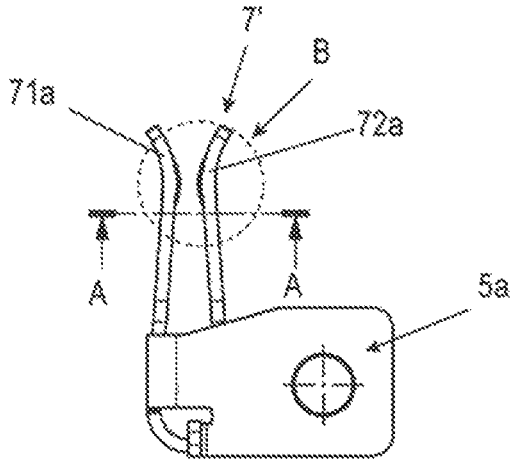
FIG. 10*b* is a side view of the bus plug shown in FIG. 10*a;*

In addition, the opposing spring legs of the socket contacts 7' are divided in the array direction X into multiple contact portions 71*a, b, c, d, e, f* and 72*a, b, c, d, e, f*, which are each separated in the array direction X by notches 73 as shown in FIG. 10*a*. This results in a quasi-flexible deformable socket contact 7 for the second connecting contact K2 which is connected with the first connecting contact K1.

The contact portions 71*a, b, c, d, e, f* and 72*a, b, c, d, e, f* are preferably opposite to one another. A division into a number of contact portions 71*a, b, c, d, e, f* and 72*a, b, c, d, e, f* other than that shown is also possible. Each two of the contact portions 71*a, b, c, d, e, f* and 72*a, b, c, d, e, f* can cooperate to form a contact socket. The slotted contact zone 8' is formed between the two rows of contact portions 71*a, b, c, d, e, f* and 72*a, b, c, d, e, f*.

Half of the contact portions, i.e. portions 71*a, b, c* and 72*a, b, c*) are used for contacting the end of one respective first power rail strip 300, 301 from an adjacent socket contact 7' and another half of the contact portions 71*d, e, f* and 72*d, e, f* are preferably used for contacting power rail strip 300, 301 adjoining a further socket contact 7' on the opposing side. In a first or last electronics housing of an electronics housing assembly 100', all contact portions 71*a, b, c, d, e, f* and 72*a, b, c, d, e, f* of the respective socket contact 7 can be contacted as a whole by each of the ends of a power rail strip 30, 31', for example, to be able to feed a higher power in via more contact points.

If the power rail strips 300, 301 are arranged obliquely in relation to the array direction X because of tolerances, in order to be able to connect adjacent bus plugs 2 of adjacent electronics housings, this design offers the advantage that it is possible to deflect the respective contact portions 71*a, b, c, d, e, f* and 72*a, b, c, d, e, f* differently, in particular by different amounts. A good electrical contact is nonetheless ensured in this case. Such a situation is schematically shown in FIG. 9. In this case, bus plugs 2 having socket contacts as shown in FIGS. 10*a*-10*d* and 11*a*-11*e* can be used.

Figure 10D:
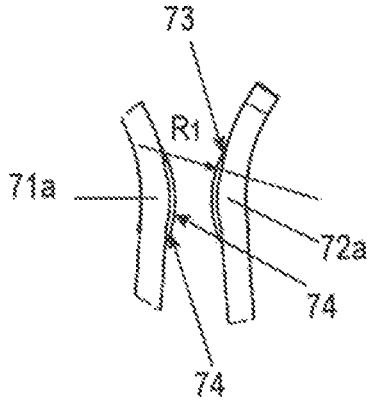
FIG. 10*d* is an enlarged illustration of the detail B of FIG. 10*b;*
Figure 11C:
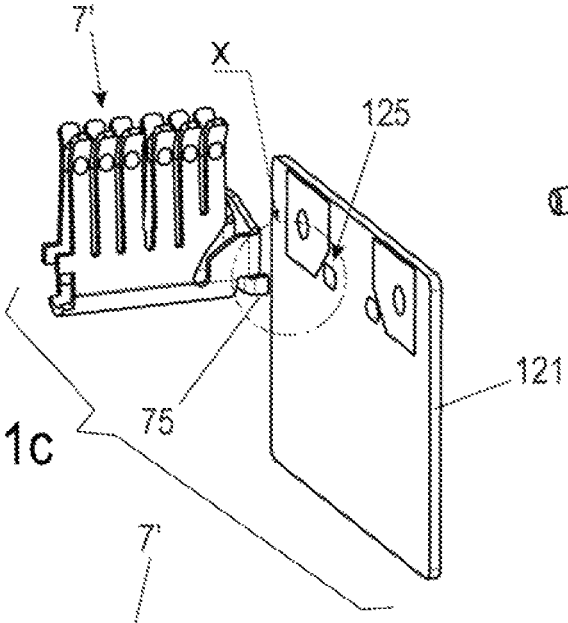
FIG. 11*c* an exploded view of FIG. 11*a;*
Figure 11D:
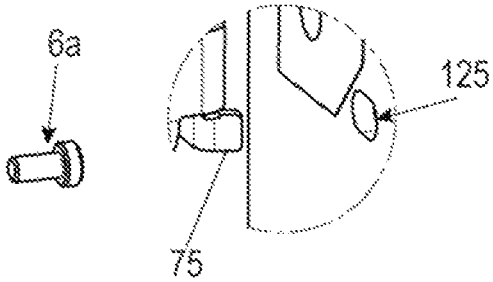
FIG. 11*d* is an enlarged illustration of detail X of FIG. 11*c*.
Figure 11E:
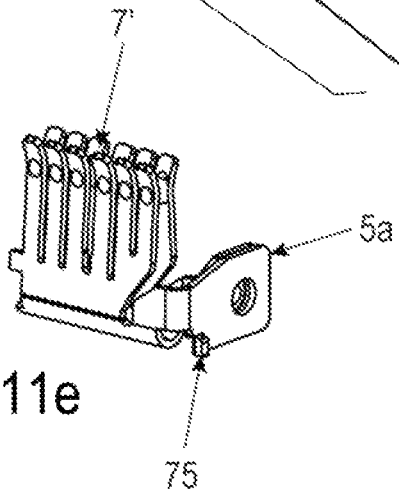
FIG. 11*e* is a perspective view of an alternate embodiment of the bus plug of FIG. 11*c*.
Figure 11A:
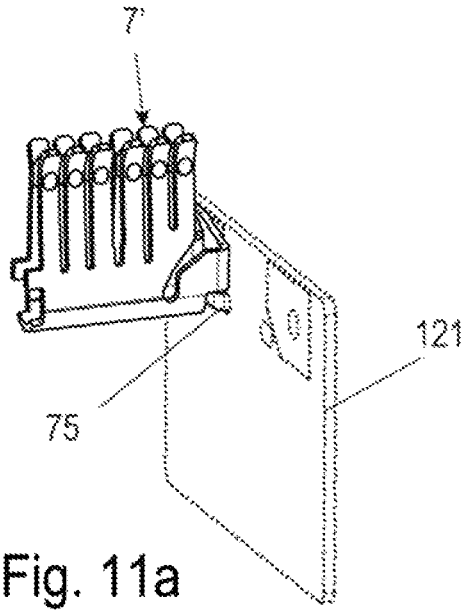
FIGS. 11*a* and 11*b* are front and rear perspective views, respectively of a bus plug according to an alternate embodiment.
Figure 11B:
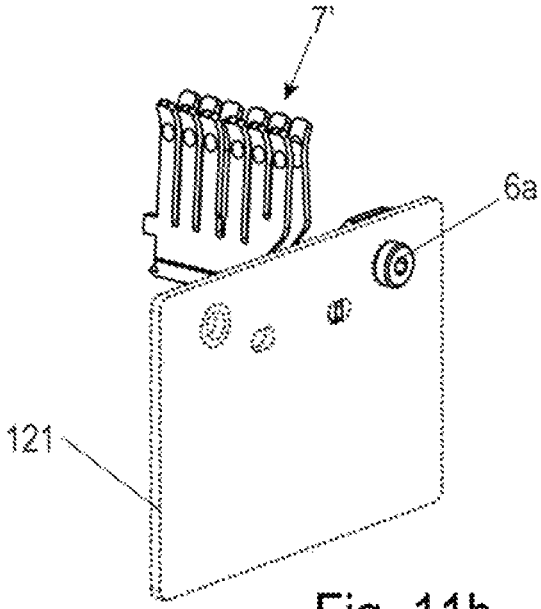

The contact portions 71*a, b, c, d, e, f* and 72*a, b, c, d, e, f* are preferably rounded with a radius R1 as shown in FIG. 10*d* in the sides facing each other. For this purpose, corresponding embossments can be introduced into the contact portions 71*a, b, c, d, e, f* and 72*a, b, c, d, e, f*, so that convex contact regions 74 are formed toward the respective contact side as shown in FIGS. 10*a*-10*d*. In this way, power rail strips 300, 301 which are aligned obliquely in relation to the array direction because of tolerances are in contact since the power rail strips 300, 301 can be arranged tangentially or optimized to the respective contact regions 74 as a result of an inclined position.

One or more of the first connecting contacts K1 on the first connecting side A are formed as a screw terminal 5*a* with or without a nut as shown in FIGS. 11*a*-11*e*. This screw terminal 5*a* receives a screw 6*a* for connection with a circuit hoard 121. A projection 75 is provided on the respective socket contact 7' which engages in a formfitting manner with a corresponding opening such as a passage hole 125 of the circuit board to be contacted. In this way, an additional twist lock or other type of alignment aid is provided between the respective socket contact 7' and the respective circuit board 121 so that the respective socket contact 7' is supported in a formfitting manner via a lug on the circuit board 121.

What is claimed is:

1. A contact and busbar assembly, comprising (a) at least one bus plug having at least one first connecting contact, at least one second connecting contact configured as a socket contact; and (b) at least one power rail strip having a flexible middle section and nonflexible sections on opposite ends of said flexible middle section, said nonflexible sections of said power rail strip being connected with said socket contacts of adjacent bus plugs; and (c) at least one cover removably connected with each bus plug and connected with said nonflexible sections of said power rail strip to connect adjacent bus plugs to one another, whereby said connected bus plugs define a bus system for connecting an array of electronics housings each of which contains a circuit board adapted for connection with respective first connecting contacts of an associated bus plug.

2. The contact and busbar assembly as claimed in claim 1, wherein said flexibly deformable section comprises a strip-shaped wire braid.

3. The contact and busbar assembly as claimed in claim 1, wherein at least one of said first connecting contacts comprises a screw terminal.

4. The contact and busbar assembly as claimed in claim 1, wherein at least one of said first connecting contacts comprises a solder terminal.

5. The contact and busbar assembly as claimed in claim 1, wherein said flexible section comprises a multilayered sheet metal strip.

6. The contact and busbar assembly as claimed in claim 1, wherein said flexible section comprises a conductive metal.

7. The contact and busbar assembly as claimed in claim 1, wherein said power rail strip comprises a continuous flexible section.

8. The contact and busbar assembly as claimed in claim 1, wherein each socket contact comprises spaced opposing spring legs which define a slotted contact zone aligned in parallel to the array of electronics housings.

9. The contact and busbar assembly as claimed in claim 1, wherein each socket contact includes a projection which engages in a formfitting manner in a corresponding opening of the respective circuit board to form a twist lock connection with the respective circuit board.

10. The contact and busbar assembly as claimed in claim 8, wherein said spaced opposing spring legs are divided in the array direction into multiple contact portions which are separated in the array direction by, notches.

11. A contact and busbar assembly, comprising (a) at least one bus plug having at least one first connecting contact and at least one second connecting contact configured as a socket contact; and (b) at least one power rail strip connected with socket contacts of adjacent bus plugs to define a bus system tar connecting an array of electronics housings each of which contains a circuit board adapted for connection with respective first connecting contacts of an associated bus plug, said at least one power rail strip extending at least one of parallel and obliquely in relation to the array of electronics housings to accommodate offsets of electronics housings in the array.

12. The contact and busbar assembly as claimed in claim 11, said at least one power rail strip is rigid.

13. The contact and busbar assembly as claimed in claim 12, wherein said socket contacts include convex sections facing toward one another for receiving said at least one power rail strip.

14. The contact and busbar assembly as claimed in claim 12, wherein said power rail strip is formed of a conductive metal.

* * * * *